US008876561B2

(12) United States Patent
Endo et al.

(10) Patent No.: US 8,876,561 B2
(45) Date of Patent: Nov. 4, 2014

(54) ELECTRICAL CONNECTOR HAVING MEANS TO PREVENT TERMINAL SPACES FALLING APART FROM A CIRCUIT BOARD

(71) Applicant: Dai-Ichi Seiko Co., Ltd., Kyoto (JP)

(72) Inventors: Takayoshi Endo, Shizuoka (JP); Daisuke Matsushita, Shizuoka (JP)

(73) Assignee: Dai-Ichi Seiko Co., Ltd., Kyoto (JP)

( * ) Notice: Subject to any disclaimer, the term of this patent is extended or adjusted under 35 U.S.C. 154(b) by 32 days.

(21) Appl. No.: 13/763,911

(22) Filed: Feb. 11, 2013

(65) Prior Publication Data

US 2013/0217264 A1 Aug. 22, 2013

(30) Foreign Application Priority Data

Feb. 20, 2012 (JP) ..... 2012-34463

(51) Int. Cl.

| | |
|---|---|
| ***H01R 13/514*** | (2006.01) |
| ***H01R 12/72*** | (2011.01) |
| ***H01R 13/40*** | (2006.01) |
| ***H01R 13/422*** | (2006.01) |

(52) U.S. Cl.

CPC ..... *H01R 13/40* (2013.01); *H01R 12/721* (2013.01); *H01R 13/4226* (2013.01)

USPC ..... 439/752

(58) Field of Classification Search

USPC ..... 439/752, 253–358

See application file for complete search history.

(56) References Cited

U.S. PATENT DOCUMENTS

| | | | | |
|---|---|---|---|---|
| 2,911,612 | A | 11/1959 | Jackson et al. | |
| 6,659,811 | B2 * | 12/2003 | Okamoto et al. | 439/752 |
| 6,851,987 | B2 * | 2/2005 | Mase et al. | 439/752 |
| 7,014,512 | B2 * | 3/2006 | Mase et al. | 439/752 |
| 7,344,419 | B2 * | 3/2008 | Sugiyama et al. | 439/752 |
| 7,470,157 | B2 * | 12/2008 | Hiramatsu | 439/752 |
| 7,666,015 | B2 * | 2/2010 | Sakamoto et al. | 439/260 |

FOREIGN PATENT DOCUMENTS

| | | |
|---|---|---|
| DE | 43 11 352 | 10/1993 |
| GB | 1184785 | 3/1970 |
| JP | 5-84053 | 11/1993 |

OTHER PUBLICATIONS

European Search Report (ESR) issued Mar. 18, 2013 in European Patent Application No. EP 13 15 3666.

* cited by examiner

*Primary Examiner* — Chandrika Prasad

(74) *Attorney, Agent, or Firm* — Wenderoth, Lind & Ponack, LLP

(57) ABSTRACT

An electrical connector includes a connector housing having a slot into which a circuit board is to be inserted, and a plurality of connector terminals to be inserted into the connector housing. The connector housing includes terminal spaces into which the connector terminals are inserted, and partition walls partitioning the terminal spaces from each other. The connector terminals each include a sheath to be inserted into one of the terminal spaces, and a resilient contact making electrical contact with the circuit board. The electrical connector includes a convex portion and a concave portion for preventing the terminal spaces and the circuit board from falling apart from each other. The convex portions can be formed on opposite sidewalls of the sheath, and the concave portions can be formed at the partition walls.

11 Claims, 9 Drawing Sheets

ELECTRICAL CONNECTOR HAVING MEANS TO PREVENT TERMINAL SPACES FALLING APART FROM A CIRCUIT BOARD

BACKGROUND OF THE INVENTION

1. Field of the Invention

The invention relates to an electric connector in which, when a circuit board having circuit terminals is inserted into a slot formed at the electric connector, connector terminals make electrical contact with the circuit terminals.

2. Description of the Related Art

An example of an electric connector which is called a card edge connector and into which a circuit board on which circuit terminals are formed at an edge is inserted is disclosed in Japanese Utility Model Application Publication No. H5 (1993)-84053, for instance.

In the electric connector disclosed in the publication, a connector housing is designed to have therein terminal spaces vertically formed by two stages, and a slot into which a circuit board is to be inserted, extending from a front of the connector housing and between the upper and lower terminal spaces. Connector terminals are inserted into the upper and lower terminal spaces. Each of the connector terminals has a resilient contact, which extends outwardly through an opening of a corresponding terminal space facing the slot. The resilient contacts of the connector terminals inserted into the upper terminal spaces and the resilient contacts of the connector terminals inserted into the lower terminal spaces face each other, and make resilient contact with electrical conductors formed on surfaces of the circuit board.

Hereinbelow is explained a conventional electric connector with reference to FIG. 14.

As illustrated in FIG. 14, a conventional card edge connector 10*x* into which a connector 20 having a circuit board P therein is inserted includes a connector housing 110*x*, and connector terminals 120*x* to each of which a cable C is connected.

The connector housing 110*x* is designed to have a slot 111 into which a circuit board P formed in the connector 20 is to be inserted, a circular slot 112 into which a connector housing 21 of the connector 20 is to be inserted, and terminal spaces 113*x* into which connector terminals 120*x* are to be inserted. The slot 111 defines a space surrounded by an inner wall 114, and the circular slot 112 defines a space formed between an outer wall 115 and the inner wall 114.

Each of the connector terminals 120*x* includes a sheath 121*x* inserted into the terminal space 113*x*, and a resilient contact 122 formed in the sheath 121*x* to make physical and electrical contact with a corresponding circuit terminal formed on the circuit board P.

Inserting the circuit board P into the conventional card edge connector 10*x*, the resilient contact 122 compresses a corresponding circuit terminal formed on the circuit board P, and further, the inner wall 114 of the connector housing 110*x* situated at a rear of the connector terminal 120*x* receives a compressive forced acted by the resilient contact 122. Since the connector housing 110*x* is a resin-molded product, it is influenced by an ambient temperature which may vary between high and low temperatures, resulting in that the inner wall 114 is deformed towards the outer wall 115, and thus, a height H1 of the inner wall 114 is increased up to a height H2, as illustrated in FIG. 15. Accordingly, a gap between the terminal space 113*x* and the circuit board P is widened around the slot 111. If the terminal space 113*x* were widened, a gap between the connector terminal 120*x* and the circuit board P is also widened, and hence, a contact load at which the resilient contact 122 of the connector terminal 120*x* makes contact with the circuit board P lowers. The lowered contact load brings problems that the stability in electrical contact between the card edge connector 10*x* and the circuit board P is degraded, specifically, the circuit board P is easily taken off the connector housing 110*x*, and/or oscillation brings the defectiveness in electrical contact between the circuit board P and the connector terminal 120*x*.

SUMMARY OF THE INVENTION

In view of the above-mentioned problems in the conventional card edge connector, it is an object of the present invention to provide an electric connector which is capable of ensuring the contact stability by preventing reduction in a contact load at which a connector terminal makes contact with a circuit board.

In one aspect of the present invention, there is provided an electrical connector including a connector housing having a slot into which a circuit board is to be inserted, and a plurality of connector terminals to be inserted into the connector housing, the connector housing including terminal spaces into which the connector terminals are inserted, and partition walls partitioning the terminal spaces from adjacent ones, the connector terminals each including a sheath to be inserted into one of the terminal spaces, and a resilient contact making electrical contact with the circuit board, the electrical connector including a structure for preventing the terminal spaces and the circuit board from falling apart from each other, the structure being formed on at least one of opposite sidewalls of the sheath and a partition wall or partition walls facing the at least one of opposite sidewalls of the sheath.

The electrical connector in accordance with the present invention is designed to include the structure for preventing the terminal spaces and the circuit board from falling apart from each other. The structure is formed on or at a sidewall or opposite sidewalls of the sheath and a partition wall or partition walls facing the sidewall or the opposite sidewalls of the sheath. The structure ensures that a compressive force exerted by the connector terminal on the connector housing acts not only on a connector housing at a rear of the connector terminal, but also on a partition wall of the connector housing. Thus, a compressive force exerted by the connector terminal is dispersed, and hence, a compressive force exerted on a connector housing at a rear of the connector terminal is reduced, ensuring it possible to prevent a gap between the terminal space and the circuit board from being widened. Furthermore, since it is possible to prevent a gap between the terminal space and the circuit board from being widened, it is also possible to prevent fluctuation in a contact load at which a connector terminal makes contact with a circuit board, ensuring that a contact resistance can be kept stable.

The structure can be formed in a simple form. For instance, the structure can be designed to include a convex formed at one of the at least one of opposite sidewalls of the sheath and the partition wall or partition walls, and a concave into which the convex is fit, the concave being formed at the other.

For instance, the convex may be formed at the at least one of opposite sidewalls of the sheath, and the concave may be formed on the partition wall or partition walls, in which case, the convex of the sheath is engaged with the convex of the partition wall(s), ensuring that a compressive force exerted by the connector terminal on the connector housing can be relieved.

The structure may be formed on opposite sidewalls of the sheath and partition walls facing the opposite sidewalls of the sheath, in which case, a convex formed at one of the opposite sidewalls of the sheath or the partition wall facing the one of the opposite side walls of the sheath may be located at a different height from a convex formed at the other of the opposite sidewalls of the sheath or the partition wall facing the other of the opposite sidewalls of the sheath.

In brief, the convex and the concave in a first terminal space are located at a different height from the convex and the concave in a second terminal space located adjacent to the first terminal space. Since the convexes in the first and second terminal spaces do not interfere with each other, the first and second terminal spaces can be situated close to each other.

The concave may be formed at the at least one of opposite sidewalls of the sheath, and the convex may be formed at the partition wall or partition walls. Since the convexes in adjacent terminal spaces do not interfere with each other in this arrangement, the adjacent terminal spaces can be situated close to each other.

For instance, all of the structures may be formed at the same location in the terminal spaces.

For instance, at least one of the structures may be formed at a different location from the rest in the terminal spaces.

For instance, the concave comprises a linear groove extending in parallel with a direction in which the connector terminals are inserted, in which case, the convex is guided by the linear groove, and hence, a connector terminal can be smoothly inserted into a terminal space.

For instance, the convex may comprise a projection slidable perpendicularly to sidewalls of the connector terminal, and the concave may comprise a recess formed at the terminal space to receive the projection therein, the electrical connector further including a spring for actuating the slidable projections to slide outwardly of the connector terminal.

For instance, the connector terminals may be inserted into the connector housing such that a first group of connector terminals faces a second group of connector terminals with the circuit board being situated therebetween.

In another aspect of the present invention, there is provided a connector housing having a slot into which a circuit board is to be inserted, a plurality of connector terminals being to be inserted into the connector housing, the connector housing including terminal spaces into which the connector terminals are inserted, and partition walls partitioning the terminal spaces from adjacent ones, the connector terminals each including a sheath to be inserted into one of the terminal spaces, and a resilient contact making electrical contact with the circuit board, the sheath being formed on at least one of opposite sidewalls thereof with a convex or a concave, the partition wall or partition walls facing the at least one of opposite sidewalls of the sheath being formed with a concave or a convex for preventing the terminal spaces and the circuit board from falling apart from each other.

In the connector housing in accordance with the present invention, it is preferable that the concave is defined by a linear groove extending in parallel with a direction in which the connector terminals are inserted.

The advantages obtained by the above-mentioned present invention will be described hereinbelow.

Since the electrical connector in accordance with the present invention is able to reduce a compressive force exerted on a connector housing at a rear of a connector terminal, it is possible to prevent a gap between a terminal space and a circuit board from being widened. Thus, since the electrical connector in accordance with the present invention can prevent a gap between a terminal space and a circuit board from being widened, it is also possible to prevent a contact load at which a connector terminal makes contact with a circuit board from being reduced, maintaining stability of a contact between a connector terminal and a circuit board.

The above and other objects and advantageous features of the present invention will be made apparent from the following description made with reference to the accompanying drawings, in which like reference characters designate the same or similar parts throughout the drawings.

DETAILED DESCRIPTION OF THE PREFERRED EMBODIMENTS

First Embodiment

An electrical connector (hereinafter, called "a card edge connector") in accordance with the first embodiment of the present invention is described hereinbelow with reference to the drawings.

Figure 1:
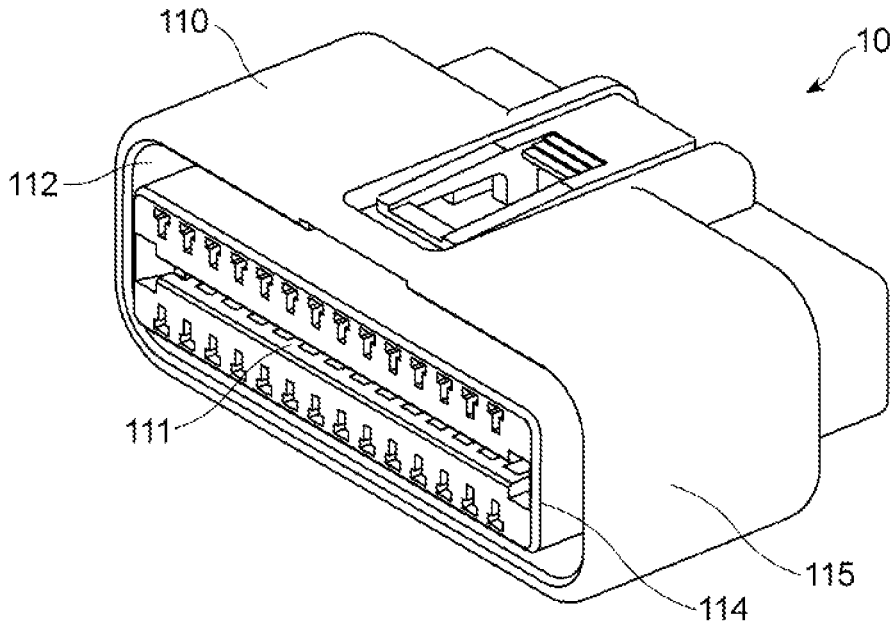
FIG. 1 is a perspective view of the card edge connector in accordance with the first embodiment of the present invention.
Figure 2:
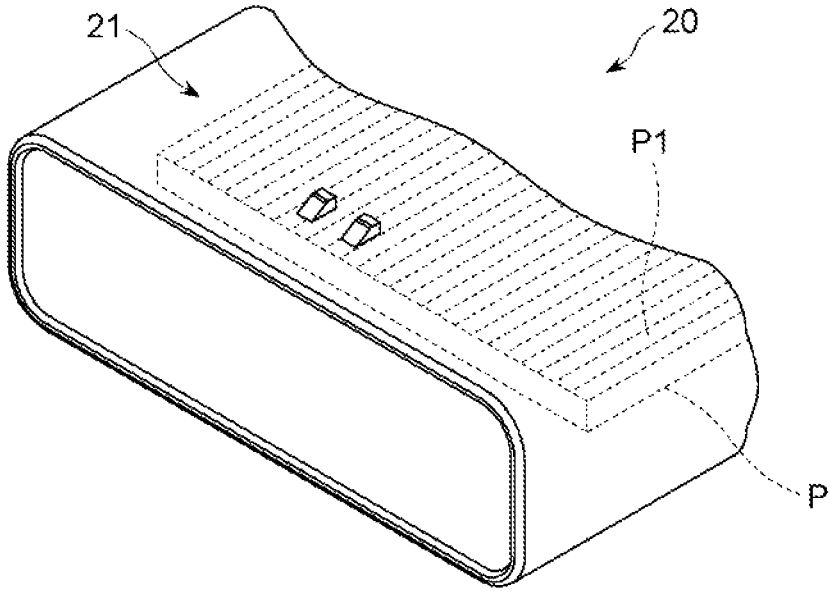
FIG. 2 is a perspective view of a connector including a circuit board therein, which is inserted into the card edge connector illustrated in FIG. 1.
Figure 3:
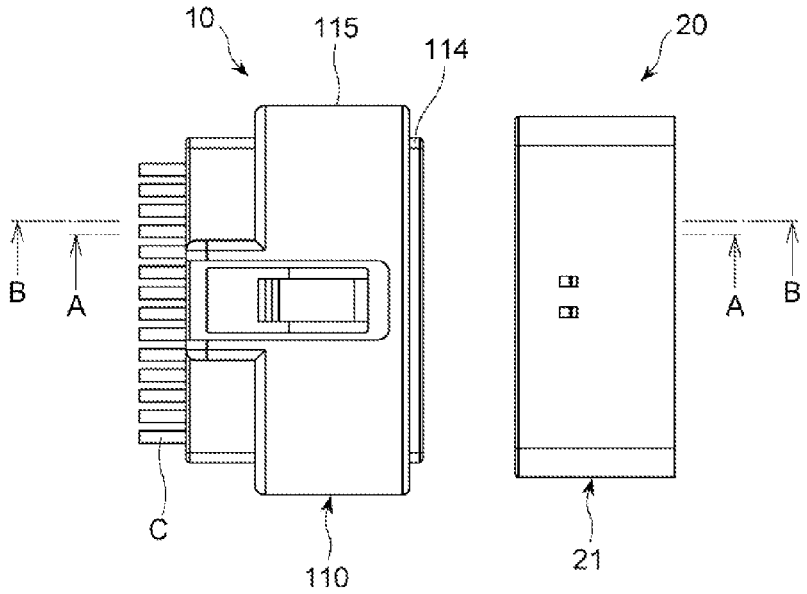
FIG. 3 is a plan view illustrating both the card edge connector illustrated in FIG. 1 and the connector illustrated in FIG. 2.

As illustrated in FIGS. 1 to 3, when a connector 20 equipped in a metal case including therein electronic devices used for an automobile is inserted into a card edge connector 10 in accordance with the first embodiment of the present invention, the card edge connector 10 electrically connects the electronic devices to cables C electrically connected to the card edge connector 10.

As illustrated in FIGS. 4 to 7, the card edge connector 10 includes a connector housing 110 and a plurality of connector terminals 120.

The connector housing 110 is a resin-molded product. The connector housing 110 is designed to include a slot 111 into which a circuit board P of the connector 20 is to be inserted, a circular slot 112 into which a connector housing 21 of the connector 20 is to be inserted, and a plurality of terminal spaces 113 into which the connector terminals 120 are to be inserted.

The slot 111 defines a space surrounded by an inner wall 114, and the circular slot 112 defines a space formed between an outer wall 115 and the inner wall 114. The slot 111 is formed at a half of a total height of the connector housing 111, and extends horizontally in a width-wise direction of the connector housing 111, as illustrated in FIG. 2. The slot 111 has a size into which the circuit board P can be inserted.

The circular slot 112 is defined by an outer surface of the inner wall 114 and an inner surface of the outer wall 115. The circular slot 112 has a first portion 112*b* including an opening of the circular slot 112 and having a thickness greater than a thickness of the connector housing 21 in order for the connector 20 to be smoothly inserted thereinto, and a second portion 112*a* located at a back of the first portion and having a thickness smaller than the same of the first portion 112*b* in order for the connector housing 21 to be tightly inserted thereinto.

Figure 5:
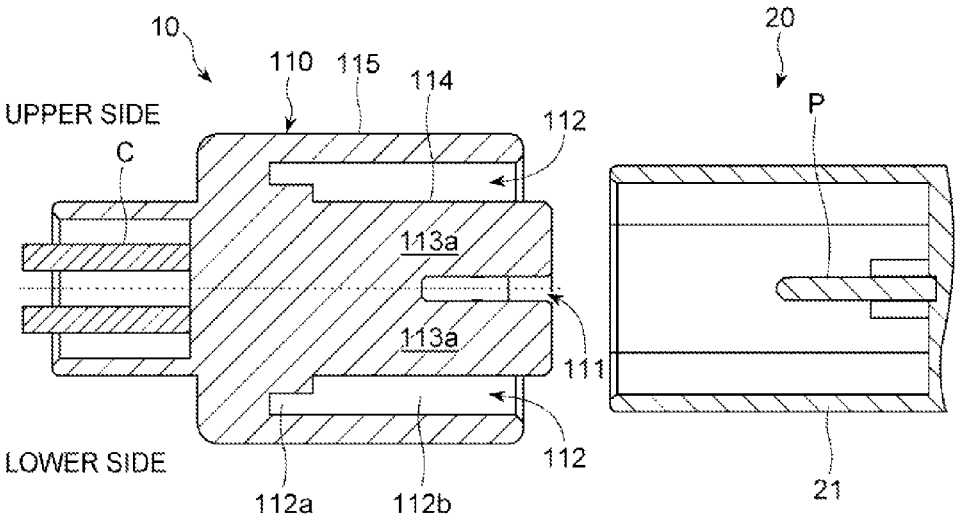
FIG. 5 is a cross-sectional view taken along the line B-B shown in FIG. 3.
Figure 6:
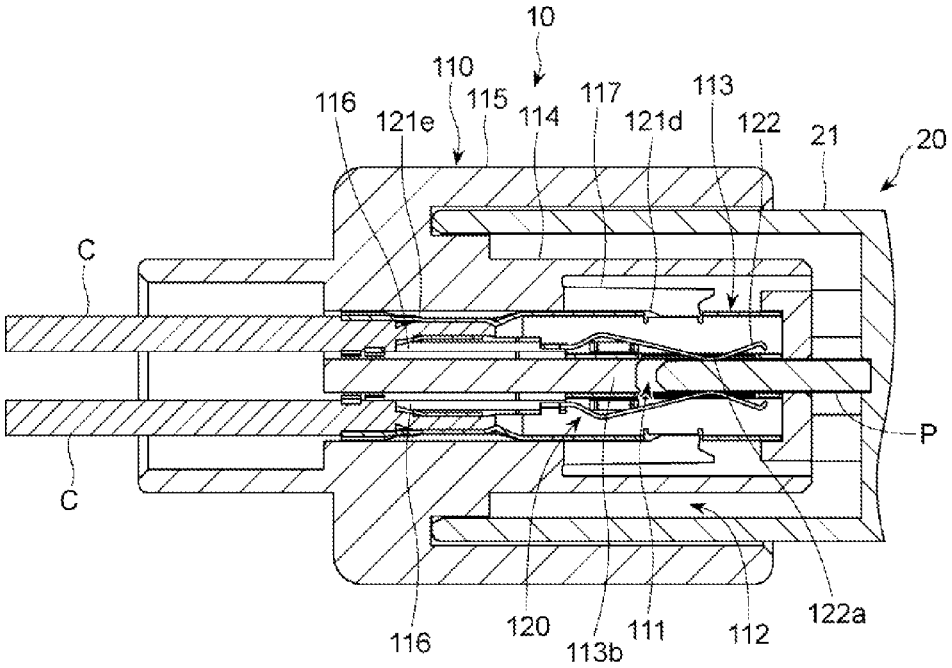
FIG. 6 is a cross-sectional view of the card edge connector and the connector inserted into the card edge connector both illustrated in FIG. 3.

As illustrated in FIG. 5, a first group of the terminal spaces 113 is arranged at an upper side of and along the slot 111, and a second group of the terminal spaces 113 is arranged at a lower side of and along the slot 111.

Each of the terminal spaces 113 is open at a rear end (an opposite side with respect to the slot 111) in order for the connector terminal 120 to be inserted into the connector housing 110 therethrough. The terminal spaces 113 located adjacent to each other are separated by a partition wall 113*a*.

The partition walls 113*a* located at the upper side and the partition walls 113*a* located at the lower side are separated away from each other by the slot 111, but portions of the partition walls 113*a* located at the upper and lower sides, situated closer to the cables C than the slot 111, are integral with each other. Accordingly, the inner wall 114 located at the upper side and the inner wall 114 located at the lower side are integral with each other.

Figure 8:
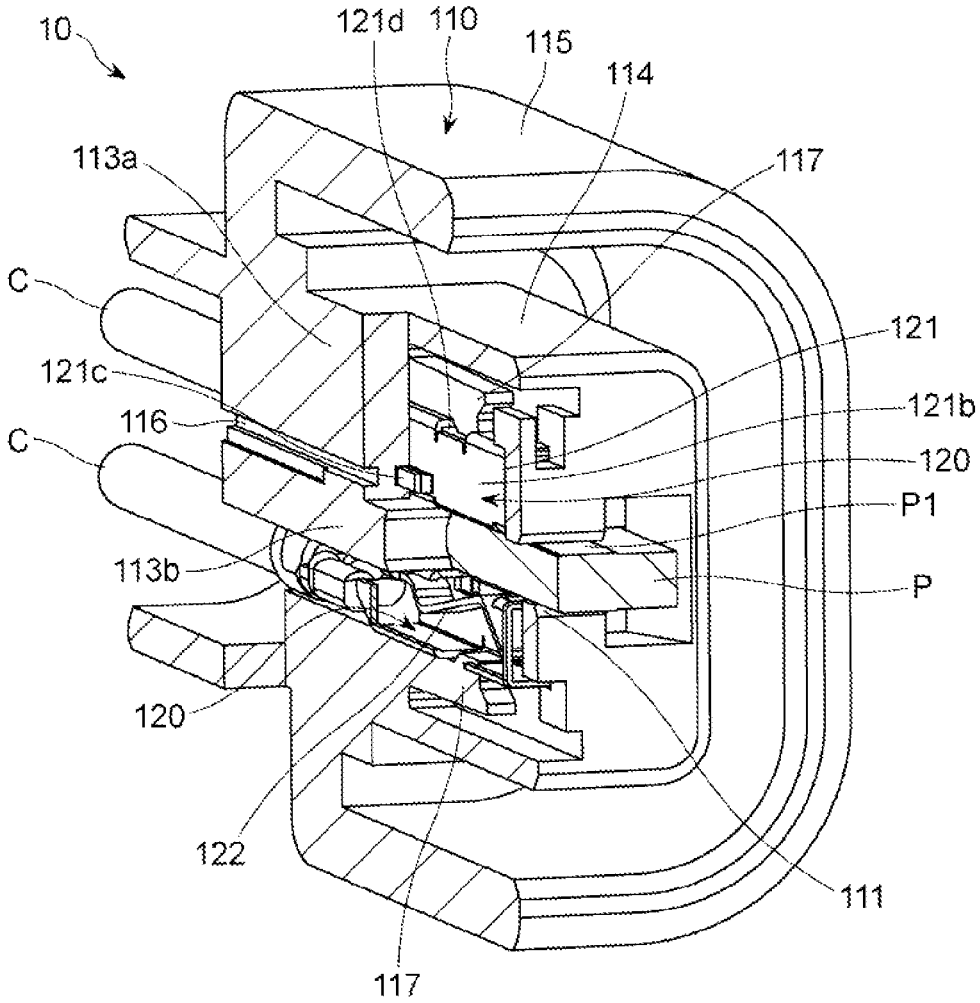
FIG. 8 is a perspective view of the card edge connector illustrated in FIG. 1 with a part thereof being removed.
Figure 9:
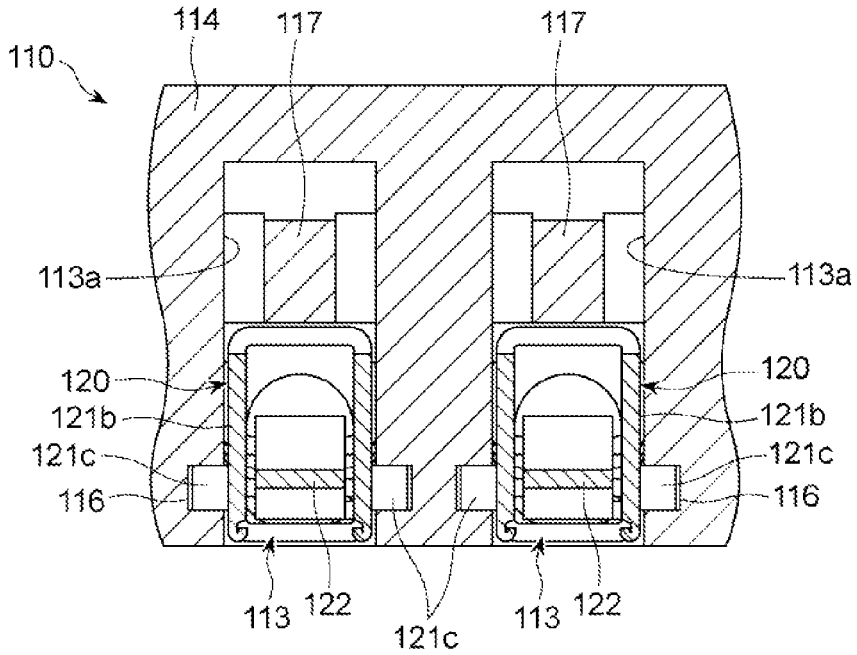
FIG. 9 is a partial cross-sectional view taken along the line C-C shown in FIG. 4.

As best illustrated in FIG. 8, each of the partition walls 113*a* is formed at opposite sides thereof with a concave, specifically, a linear groove 116 extending in parallel with a direction in which the connector terminals 120 are inserted into the connector housing 110.

The terminal spaces 113 located at the upper side and the terminal spaces 113 located at the lower side both vertically facing each other are separated by a central wall 113*b*. A front surface of the central wall 113*b* faces the circuit board P when the circuit board P is inserted into the slot 111.

Each of the terminal spaces 113 is formed at a rear thereof, specifically, at the opposite side of the circuit board P, with an engagement arm 117 in a space formed between the terminal space 113 and the inner wall 114.

Figure 7:
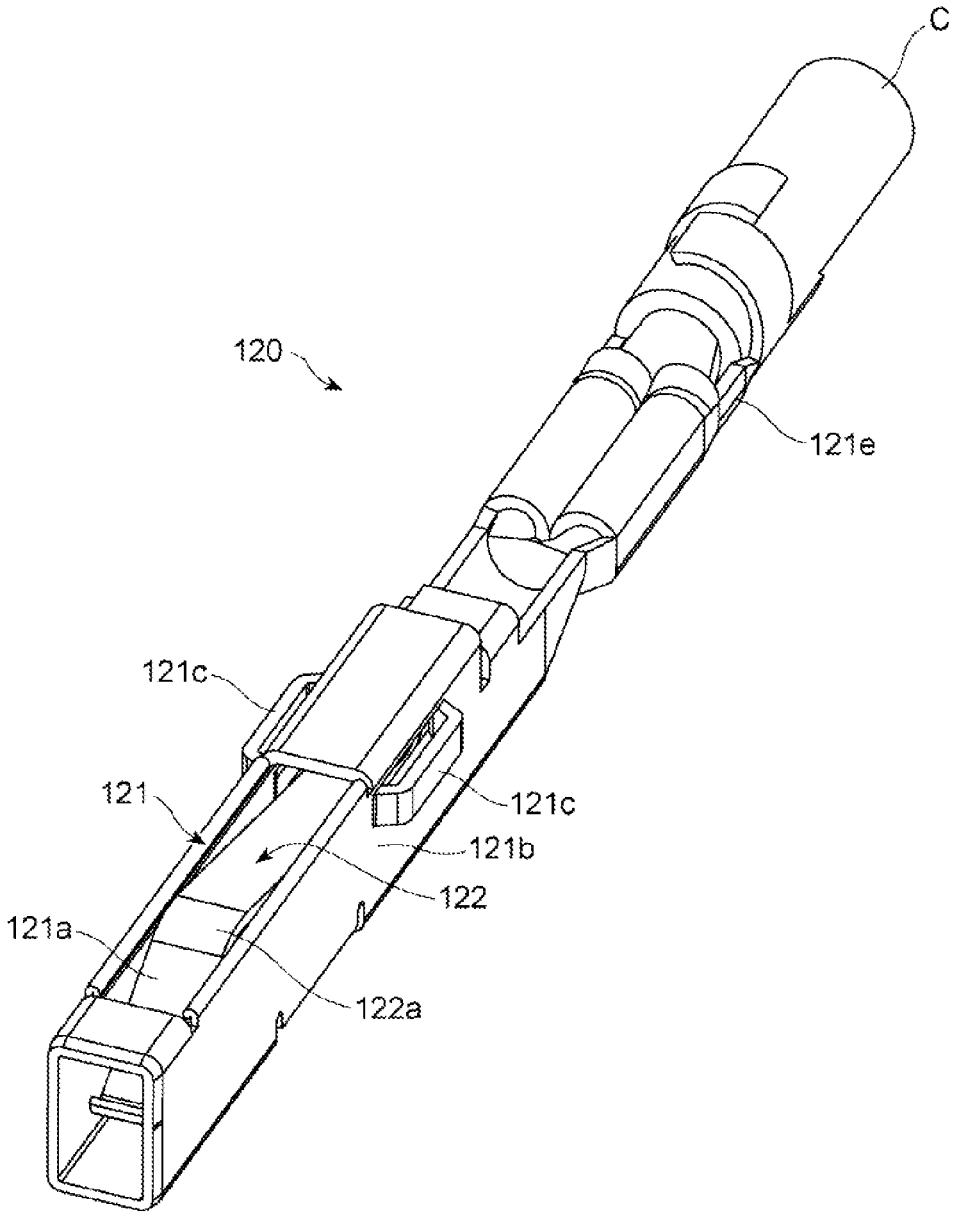
FIG. 7 is a perspective view of a connector terminal to be inserted into a connector housing.

As illustrated in FIG. 7, the connector terminal 120 includes an electrically conductive sheath 121 to be inserted into the terminal space 113 formed in the connector housing 110, and a resilient contact 122 formed in the sheath 121 in such a condition that the resilient contact 122 is electrically connected to the sheath 121.

The sheath 121 has a rectangular cross-section. The sheath 121 includes an opening 121*a* through which an electrically conductive contact 122*a* of the resilient contact 122 making electrical contact with a circuit terminal P1 projects outwardly of the sheath 121, a pair of projections 121*c* projecting from opposite sidewalls 121*b* of the sheath 121, an opening 121*d* (see FIGS. 4 and 6) to which the engagement arm 117 engages when the sheath 121 is inserted into the terminal space 113, and a binding section 121*e* in which the cable C is fixed in a compressed condition.

The projections 121*c* are located closer to a rear of the sheath 121 (or the cable C) than the slot 111, and corresponding to the linear grooves 116 formed at opposite sidewalls of the partition wall 113*a* which connects the upper and lower sides of the inner wall 114 to each other. In the first embodiment, the projections 121*c* and the linear grooves 116 are formed closer to the opening 121*a* than a center of the sidewalls 121*b*.

In the card edge connector 10, the means for preventing the terminal spaces 113 and the circuit board P from falling apart from each other is comprised of a convex defined by the projection 121*c* formed at the opposite sidewalls 121*b* of the sheath 121, and a concave defined by the linear groove 116 formed at the opposite sidewalls of the partition wall 113*a*.

The resilient contact 122 defines a plate spring because it is bent towards a rear at a proximal end fixed at the sheath 121, further bent at a distal end towards the slot 111 to thereby define the electrically conductive contact 122*a* projecting outwardly through the opening 121*a*, and further bent at a distal end towards a rear to define a distal end thereof as a free end.

The connector terminal 120 is inserted through a rear of the connector housing 110 into the terminal space 113. Since the linear groove 116 formed at opposite sidewalls of the partition wall 113*a* acts as a guide, the projections 121*c* formed at the opposite sidewalls 121*b* of the sheath 121 moves along the linear groove 116, and hence, the connector terminal 120 can be smoothly inserted into the terminal space 113. The connector terminal 120 is inserted into the terminal space 113 until the opening 121*d* of the sheath 121 reaches at a hook of the engagement arm 117. Thus, since a hook of the engagement arm 117 is engaged to the sheath 121, the connector terminal 120 cannot be readily taken off the connector housing 110, even if the cable C is pulled.

Hereinbelow is explained how to use the card edge connector 10 in accordance with the first embodiment, having such a structure as mentioned above, with reference to the drawings.

Figure 4:
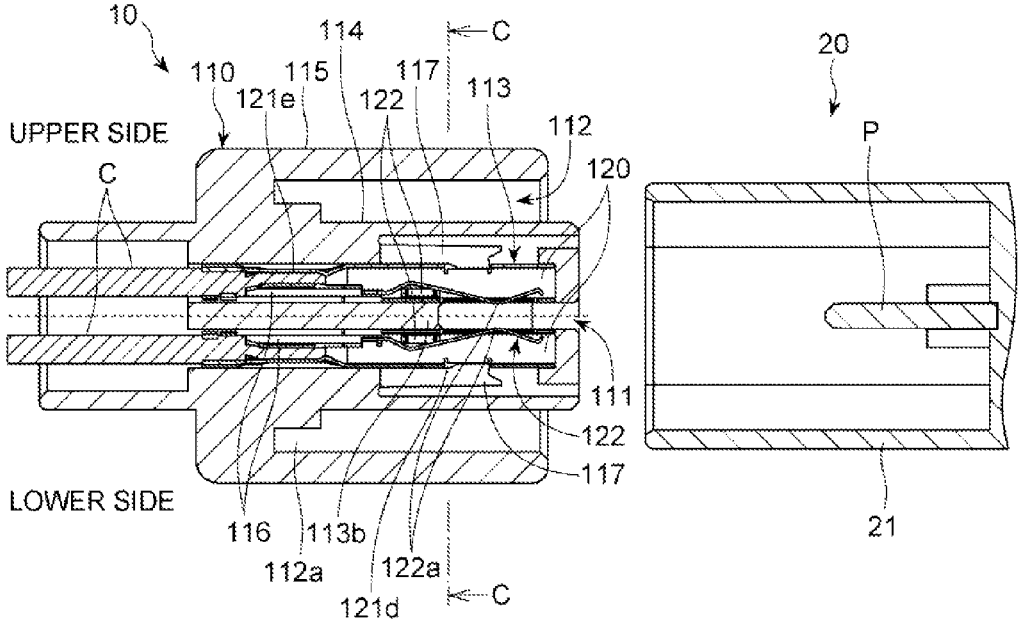
FIG. 4 is a cross-sectional view taken along the line A-A shown in FIG. 3.

As illustrated in FIG. 4, the connector housing 21 of the connector 20 is positioned at a location between the inner wall 114 and the outer wall 115 of the connector housing 110 of the card edge connector 10. Then, the card edge connector 10 is moved such that the connector housing 110 of the card edge connector 10 is inserted into the connector 20. Thus, the circuit board P is inserted into the slot 111.

The circuit board P is inserted into the slot 111, and further pushed into the slot 111. Then, the circuit board P makes contact with the electrically conductive contact 122*a* of the resilient contact 122. The circuit board P moves in such a condition that the circuit terminal P1 thereof makes contact with and slides on the electrically conductive contact 122*a*. Finally, the circuit board P comes at a front thereof into the central wall 113*b*.

Since the resilient contact 122 of the connector terminal 120 has a resilient force, the resilient contact 122 compresses the circuit terminal P1 of the circuit board P. The inner wall 114 of the connector housing 110 located at a rear of the connector terminal 120 receives a compressive force from the resilient contact 122. The compressive force causes a gap between the terminal space 113 and the circuit board P to be widened.

However, since the projection 121*c* of the sheath 121 is engaged to the linear groove (concave) 116 of the partition wall 113*a*, the compressive force exerted by the connector terminal 120 acts not only on the inner wall 114 situated at a rear of the connector terminal 120, but also on the partition wall 113*a* to which the projection 121*c* is engaged, resulting in that the compressive force exerted by the connector terminal 120 is dispersed. Thus, it is possible to lower the compressive force acting on the inner wall 114 situated at a rear of the connector terminal 120.

Furthermore, even if the compressive force exerted by the projection 121*c* of the sheath 121 acts on the linear groove 160, since the linear groove 160 is formed at the partition wall 113*a* connecting the upper and lower sides of the inner wall 114, an interval between the upper and lower sides of the inner wall 114 is not widened, and thus, it is possible to suppress the compressive force exerted by the connector terminal 120.

As explained above, it is possible to prevent a gap between the terminal space 113 and the circuit board P from being widened by engaging the projection 121*c* of the connector terminal 120 to the linear groove 116 formed at the partition wall 113.

Since it is possible to prevent reduction in a contact load at which the connector terminal 120 makes contact with the circuit board P by preventing a gap between the terminal space 113 and the circuit board P from being widened, contact stability between the connector terminal 120 and the circuit board P can be maintained.

In addition, since the concave is defined by the linear groove 116 formed at the partition wall 113*a* and extending in parallel with a direction in which the connector terminal 120 is inserted into the connector housing 110, the linear groove 116 guides the projection 121*c*, ensuring that the connector terminal 120 can be smoothly inserted into the terminal space 113.

It should be noted that the card edge connector 10 in accordance with the first embodiment is not to be limited to the above-mentioned structure. The card edge connector 10 in accordance with the first embodiment includes alternatives as follows.

The connector housing 110 of the card edge connector 10 in accordance with the first embodiment is designed to include a first group of the connector terminals 120 and a second group of the connector terminals 120 both of which face each other with the slot 111 or the circuit board P being situated therebetween. It should be noted that the connector housing 110 may be designed to include one of the first group of the connector terminals 120 and the second group of the connector terminals 120.

In the card edge connector 10 in accordance with the first embodiment, the terminal space 130 is designed to include the linear grooves 116 at opposite inner sidewalls of the partition wall 113*a*, and the sheath 121 is designed to include the projections 121*c* at the opposite sidewalls 121*b* thereof.

As an alternative, the terminal space 130 may be designed to include a single linear groove 116 at one of opposite inner sidewalls of the partition wall 113*a*, and accordingly the sheath 121 may be designed to include a single projection 121*c* at one of the opposite sidewalls 121*b* thereof.

Second Embodiment

Figure 10:
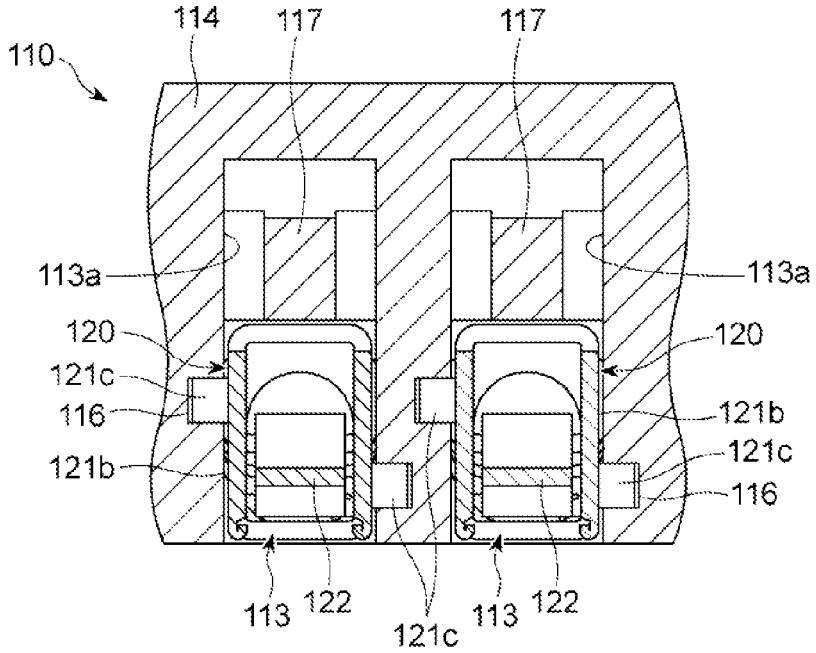
FIG. 10 is a partial cross-sectional view of the card edge connector in accordance with the second embodiment of the present invention.

FIG. 10 is a cross-sectional view of a card edge connector in accordance with the second embodiment of the present invention.

Parts or elements that correspond to those of the card edge connector in accordance with the first embodiment have been provided with the same reference numerals, operate in the same manner as corresponding parts or elements in the first embodiment, unless explicitly explained hereinbelow, and are not explained in detail.

In the card edge connector in accordance with the second embodiment, the linear grooves 116 are formed at opposite sidewalls of the partition wall 113*a* at a different height from each other, as illustrated in FIG. 10. Specifically, the linear groove 116 formed at a left sidewall of a certain partition wall 113*a* is situated lower than the linear groove 116 formed at a right sidewall of the partition wall 113*a*, for instance. In other words, the linear groove 116 formed at a left sidewall of a certain partition wall 113*a* is situated closer to the slot 111 (not illustrated in FIG. 10), and the linear groove 116 formed at a right sidewall of the partition wall 113*a* is situated closer to the engagement arm 117.

The projections 121*c* of the sheath 121 are formed in accordance with the linear grooves 116.

By designing the linear grooves 116 to be formed at a different height from each other, the adjacent projections 121*c* do not interfere with each other, and hence, it is possible to form the adjacent terminal spaces 113 closer to each other than the terminal spaces 113 in the first embodiment. Thus, the card edge connector in accordance with the second embodiment can provide the same advantages as those provided by the card edge connector in accordance with the first embodiment, and provide the additional advantage that the adjacent terminal spaces 113 can be formed at a smaller pitch than the adjacent terminal spaces 113 in the first embodiment.

Third Embodiment

Figure 11:
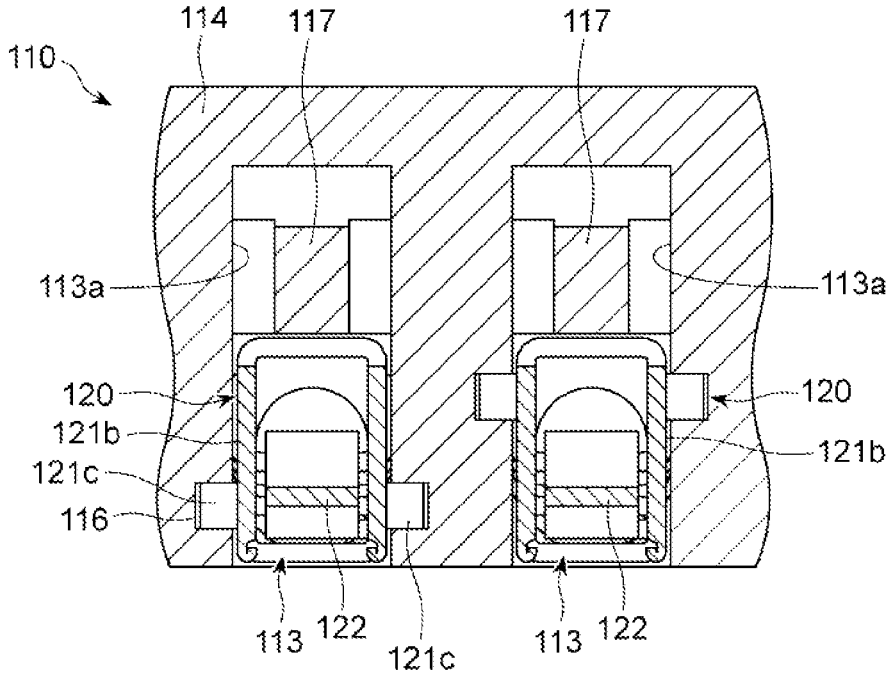
FIG. 11 is a partial cross-sectional view of the card edge connector in accordance with the third embodiment of the present invention.

FIG. 11 is a cross-sectional view of a card edge connector in accordance with the third embodiment of the present invention.

Parts or elements that correspond to those of the card edge connector in accordance with the first embodiment have been provided with the same reference numerals, operate in the same manner as corresponding parts or elements in the first embodiment, unless explicitly explained hereinbelow, and are not explained in detail.

In the card edge connector in accordance with the third embodiment, a combination of the linear grooves 116 and the projections 121*c* in a first terminal space 113 is located at a different height from a height of a combination of the linear grooves 116 and the projections 121*c* in a second terminal space 113 located adjacent to the first terminal space 113.

The projections 121*c* of the sheath 121 are formed in accordance with the linear grooves 116. Accordingly, the sheath 121 corresponding to the first terminal space 113 includes the projections 121*c* located at a different height from the projections 121*c* of sheath 121 corresponding to the second terminal space 113.

Similarly to the second embodiment illustrated in FIG. 10, since the projections 121*c* in the first terminal space 113 are located at a different height from the projections 121*c* in the second terminal space 113, the projections 121*c* in the first and second terminal spaces 113 do not interfere with each other, and hence, it is possible to form the adjacent terminal spaces 113 closer to each other than the terminal spaces 113 in the first embodiment. Thus, the card edge connector in accordance with the third embodiment can provide the same advantages as those provided by the card edge connector in accordance with the first embodiment, and provide the additional advantage that the adjacent terminal spaces 113 can be formed at a smaller pitch than the adjacent terminal spaces 113 in the first embodiment.

Fourth Embodiment

Figure 12:
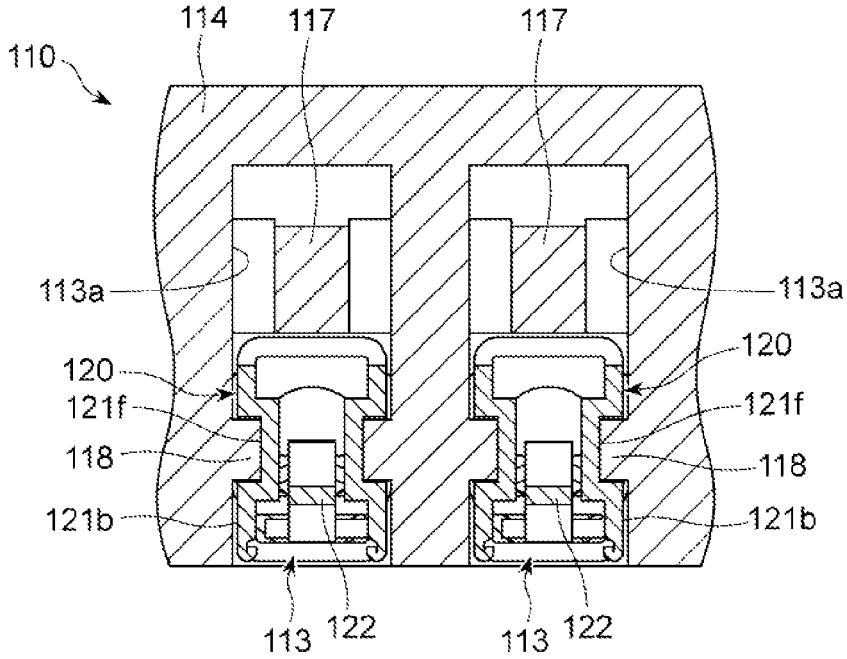
FIG. 12 is a partial cross-sectional view of the card edge connector in accordance with the fourth embodiment of the present invention.
Figure 13:
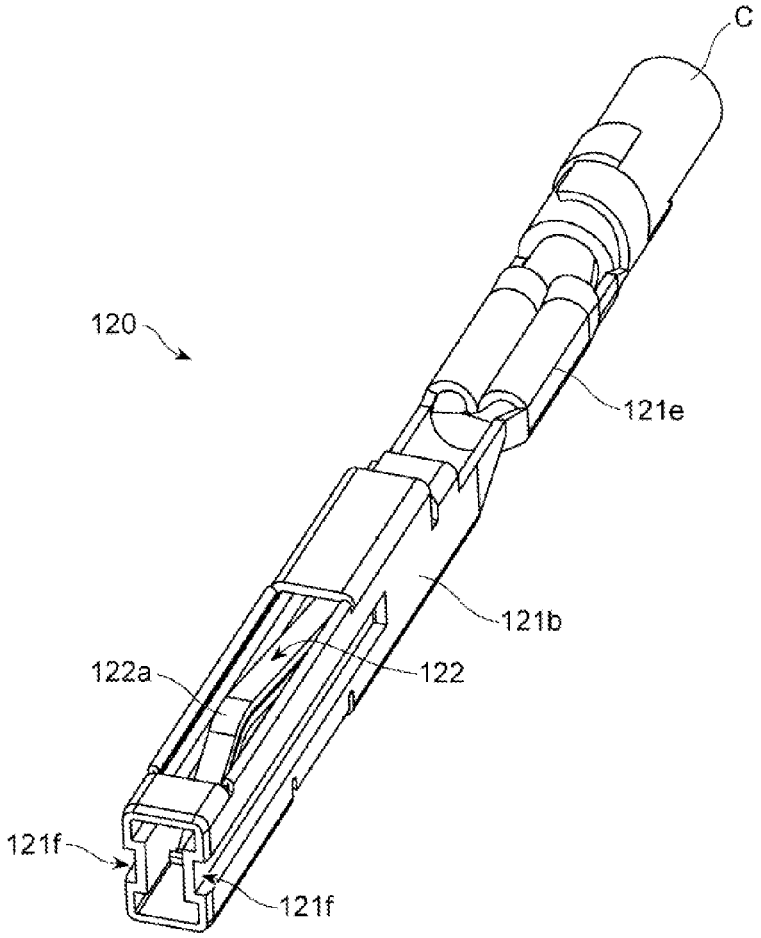
FIG. 13 is a perspective view of a connector terminal to be inserted into the card edge connector illustrated in FIG. 12.
Figure 14:
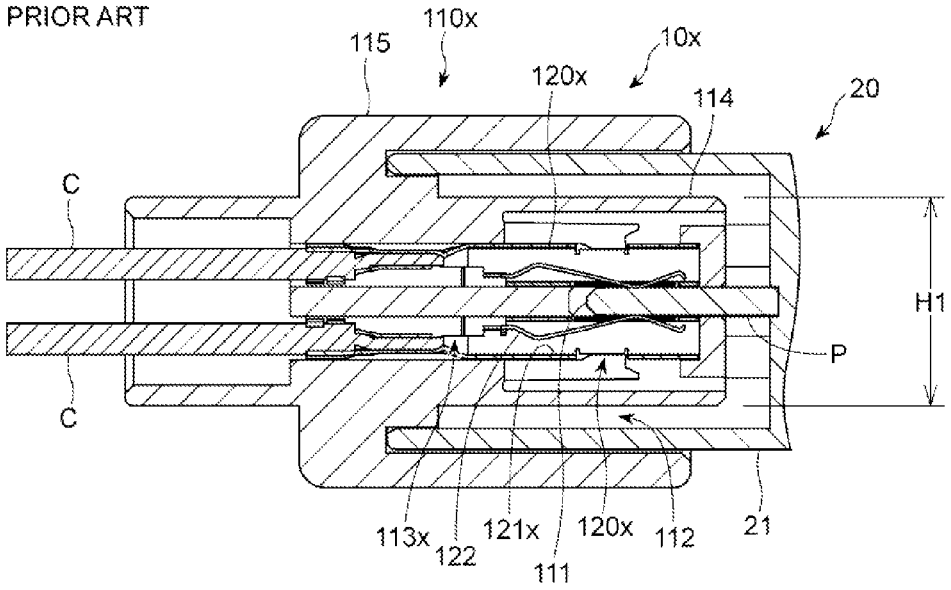
FIG. 14 is a cross-sectional view of a conventional card edge connector.
Figure 15:
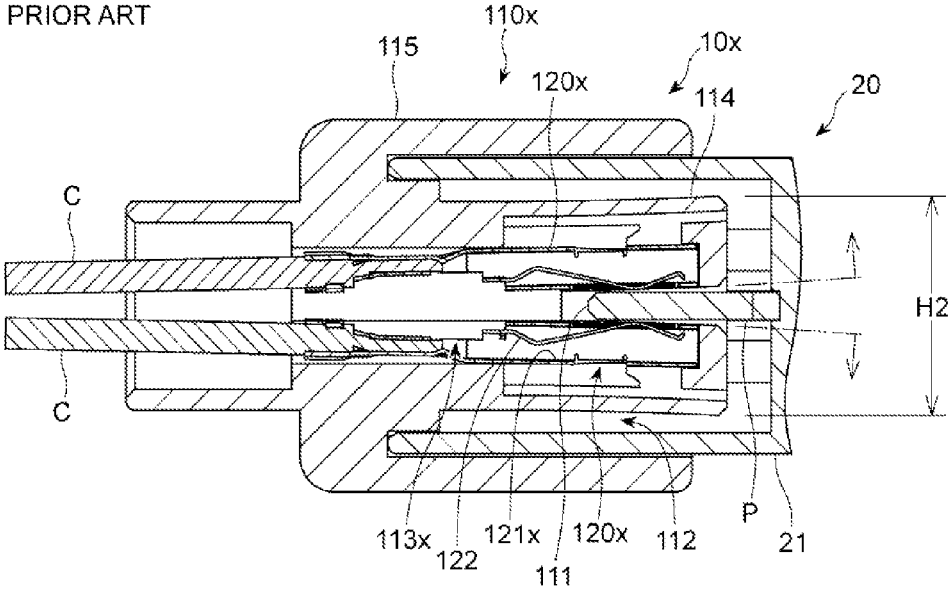
FIG. 15 is a cross-sectional view showing how the conventional card edge connector illustrated in FIG. 14 deforms with the passage of time.

FIG. 12 is a cross-sectional view of a card edge connector in accordance with the fourth embodiment of the present invention, and FIG. 13 is a perspective view of a connector terminal to be employed in the fourth embodiment.

Parts or elements that correspond to those of the card edge connector in accordance with the first embodiment have been provided with the same reference numerals, operate in the same manner as corresponding parts or elements in the first embodiment, unless explicitly explained hereinbelow, and are not explained in detail.

In the card edge connector in accordance with the fourth embodiment of the present invention, the sheath 121 of the connector terminal 120 is formed at opposite sidewalls thereof with linear grooves 121*f* acting as a concave, and the partition wall 113*a* is formed at opposite sidewalls thereof with projections 118 acting as a convex.

In the card edge connector in accordance with the fourth embodiment, in contrast with the card edge connector in accordance with the first embodiment, the sheath 121 is designed to include the linear grooves 121*f*, and the partition wall 113*a* is designed to include the projections 118. Thus, since the projections 118 located adjacent to each other do not interfere with each other, it is possible to form the adjacent terminal spaces 113 closer to each other than the terminal spaces 113 in the first embodiment. Thus, the card edge connector in accordance with the fourth embodiment can provide the same advantages as those provided by the card edge connector in accordance with the first embodiment, and provide the additional advantage that the adjacent terminal spaces 113 can be formed at a smaller pitch than the adjacent terminal spaces 113 in the first embodiment.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

For instance, the means for preventing the terminal spaces 113 and the circuit board P from spacing away from each other is comprised of a combination of a convex and a concave in the first to fourth embodiments. As an alternative, the means may be designed to be comprised of a wedge-shaped projection formed at the connector terminal 120, in which case, the wedge-shaped projection is engaged to the partition wall 113*a* by being embedded into the partition wall 113*a*.

For another instance, the projections 121*c* may be designed to be slidable perpendicularly to the sidewalls 121*b* of the sheath 121, in which case, the sheath 121 is designed to include springs for actuating the slidable projections 121*c* to slide outwardly of the sheath 121. In the case that the projections 121*c* are slidable perpendicularly to the sidewalls 121*b* of the sheath 121, the partition wall 113*a* may be designed to have just recesses at opposite sidewalls thereof in place of the linear groove 116 in order to receive the slidable projections 116 therein.

Since the connector 20 includes the connector housing 21 in the above-mentioned first to fourth embodiments, the connector housing 110 of the card edge connector 10 is designed to include the outer wall 115 and the inner wall 114. In the case that only the circuit board P is inserted into the card edge connector 10, the connector housing 110 may be designed not to include the outer wall 115, and to include only the inner wall 114.

The electrical connector in accordance with the present invention can be employed in various fields such as an electric/electronic field and an automobile field as a connector for electric/electronic devices into which a circuit board is to be inserted, or a connector to be mounted on an automobile.

The entire disclosure of Japanese Patent Application No. 2012-34463 filed on Feb. 20, 2012 including specification, claims, drawings and summary is incorporated herein by reference in its entirety.

What is claimed is:

1. An electrical connector including:

a connector housing having a slot for receiving a circuit board formed in a second connector; and a plurality of connector terminals inserted into said connector housing, said connector housing including terminal spaces into which said connector terminals are inserted, and partition walls partitioning adjacent terminal spaces from each other, and a circular slot adapted to receive a second connector housing of the second connector, said circular slot having a first portion including an opening having a width greater than a thickness of said second connector housing, and a second portion positioned at a back side of the first portion and having a width smaller than the first portion so that the second connector housing can be inserted into a top end of the circular slot, said connector terminals each including a sheath to be inserted into one of said terminal spaces, and a resilient contact making electrical contact with said circuit board, wherein said electrical connector includes at least one prevention means formed in the terminal space for preventing said terminal spaces and said circuit board from falling apart from each other, said at least one prevention means comprising a convex portion formed at one of at least one of opposite sidewalls of said sheath and said partition walls, and a concave portion into which said convex portion can be fitted, said concave portion being formed at the other of the at least one of the opposite sidewalls of said sheath and said partition walls.

2. The electrical connector as set forth in claim 1, wherein said convex portion is formed on said at least one of opposite sidewalls of said sheath, and said concave portion is formed at said partition wall or partition walls.

3. The electrical connector as set forth in claim 1, wherein the convex portion formed at one of said opposite sidewalls of said sheath or said partition wall facing said one of said opposite side walls of said sheath of the at least one prevention means in the terminal space is located at a different height from the convex portion formed at said opposite sidewalls of said sheath or said partition wall facing said one of said opposite sidewalls of said sheath of another prevention means in the adjacent terminal space.

4. The electrical connector as set forth in claim 1, wherein said concave portion is formed in at least one of opposite sidewalls of said sheath, and said convex portion is formed at said partition wall or partition walls.

5. The electrical connector as set forth in claim 1, wherein said at least one prevention means is formed at a same location relative to another prevention means formed in the adjacent terminal space.

6. The electrical connector as set forth in claim 1, wherein said at least one prevention means is at a different location relative to another prevention means formed in the adjacent terminal space.

7. The electrical connector as set forth in claim 1, wherein said concave portion comprises a linear groove extending in parallel with a direction in which said connector terminals are inserted.

8. The electrical connector as set forth in claim 1, wherein said convex portion comprises a projection that is slidable perpendicularly relative to sidewalls of said connector terminal, and said concave portion comprises a recess formed at said terminal space to receive said projection therein, said electrical connector further including a spring for actuating said projection to slide outwardly of said connector terminal.

9. The electrical connector as set forth in claim 1, wherein said connector terminals are inserted into said connector housing such that a first group of said connector terminals faces a second group of said connector terminals with said circuit board being situated therebetween.

10. A connector housing, comprising:

a slot for receiving a circuit board formed in a second connector;

a plurality of connector terminals inserted into said connector housing;

plurality of terminal spaces into which said connector terminals are inserted, and partition walls partitioning adjacent terminal spaces from each other; and a circular slot adapted to receive a second connector housing of said second connector, said circular slot having a first portion including an opening having a width greater than a thickness of said second connector housing, and a second portion positioned at a back side of the first portion and having a width smaller than the first portion so that the second connector housing can be inserted into a top end of the circular slot, said connector terminals each including a sheath to be inserted into one of said terminal spaces, and a resilient contact making electrical contact with said circuit board, said sheath being formed on at least one of opposite sidewalls thereof with a convex portion or a concave portion, said partition wall or partition walls facing said at least one of opposite sidewalls of said sheath being formed with a concave portion or a convex portion for preventing said terminal spaces and said circuit board from falling apart from each other.

11. The connector housing as set forth in claim 10, wherein said concave portion comprises a linear groove extending in parallel with a direction in which the connector terminals are inserted.

* * * * *